US009934770B2

(12) United States Patent
Monsarrat-Chanon

(10) Patent No.: US 9,934,770 B2
(45) Date of Patent: Apr. 3, 2018

(54) ELECTRONIC INSTRUMENT AND METHOD FOR USING SAME

(71) Applicant: Digiauxine, Inc., Montreal (CA)

(72) Inventor: Hami Monsarrat-Chanon, Montreal (CA)

(73) Assignee: Digiauxine, Inc., Montreal (CA)

( * ) Notice: Subject to any disclaimer, the term of this patent is extended or adjusted under 35 U.S.C. 154(b) by 0 days.

(21) Appl. No.: 15/668,854

(22) Filed: Aug. 4, 2017

(65) Prior Publication Data

US 2017/0337911 A1 Nov. 23, 2017

Related U.S. Application Data

(63) Continuation-in-part of application No. PCT/IB2015/056992, filed on Sep. 11, 2015.

(30) Foreign Application Priority Data

Apr. 8, 2015 (CA) ..... 2 887 490

(51) Int. Cl.

| | |
|---|---|
| ***G10H 3/06*** | (2006.01) |
| ***G10H 1/00*** | (2006.01) |
| ***G10H 1/34*** | (2006.01) |
| ***G10H 1/18*** | (2006.01) |
| ***G10H 1/04*** | (2006.01) |

(52) U.S. Cl.

CPC ..... *G10H 1/0008* (2013.01); *G10H 1/04* (2013.01); *G10H 1/18* (2013.01); *G10H 1/34* (2013.01); *G10H 2220/061* (2013.01); *G10H 2220/395* (2013.01); *G10H 2220/415* (2013.01); *G10H 2230/371* (2013.01)

(58) Field of Classification Search

CPC ..... G10H 1/0008; G10H 1/04; G10H 1/18; G10H 1/34; G10H 2220/061; G10H 2220/395; G10H 2220/415; G10H 2230/371

USPC ..... 84/615, 724

See application file for complete search history.

(56) References Cited

U.S. PATENT DOCUMENTS 5,117,730 A 6/1992 Yamauchi
5,841,052 A * 11/1998 Stanton ..... G10H 1/32 84/107

(Continued)

FOREIGN PATENT DOCUMENTS

FR 2812113 A1 1/2002

OTHER PUBLICATIONS

International Search Report and Written Opinion of PCT/IB2015/056992 dated Dec. 21, 2015.

*Primary Examiner* — Jeffrey Donels

(74) *Attorney, Agent, or Firm* — Wiggin and Dana LLP; Gregory S. Rosenblatt; Jonathan D. Hall

(57) ABSTRACT

An electronic instrument comprising an elongated member, comprising a plurality of detectors aligned in the elongated member, each detector for detecting a finger-sized object in the vicinity thereof and for providing a corresponding signal; a processing unit operatively connected to the plurality of detectors, the processing unit for receiving the signals from the plurality of detectors and for generating a signal indicative of a sound to generate and a sound generating unit operatively connected to the processing unit and wherein the processing unit is located inside the elongated member.

21 Claims, 13 Drawing Sheets

(56) References Cited

U.S. PATENT DOCUMENTS

| | | | | |
|---|---|---|---|---|
| 5,929,361 | A * | 7/1999 | Tanaka | G09B 15/003 84/380 R |
| 7,667,129 | B2 * | 2/2010 | Chidlaw | G10H 1/0091 84/723 |
| 7,741,555 | B2 * | 6/2010 | Onozawa | G10H 1/34 84/337 |
| 7,829,780 | B2 * | 11/2010 | Onozawa | G10D 7/00 84/385 R |
| 8,173,887 | B2 | 5/2012 | Sullivan | |
| 8,237,041 | B1 | 8/2012 | McCauley | |
| 9,142,200 | B2 * | 9/2015 | Park | G10H 7/002 |
| 2006/0283312 | A1 * | 12/2006 | Shibata | G10D 9/043 84/724 |
| 2009/0019999 | A1 * | 1/2009 | Onozawa | G10H 1/34 84/658 |
| 2010/0083808 | A1 | 4/2010 | Sullivan | |
| 2011/0132181 | A1 * | 6/2011 | Kockovic | G10H 1/34 84/723 |
| 2013/0180384 | A1 | 7/2013 | Van Wagoner et al. | |
| 2015/0101477 | A1 | 4/2015 | Park et al. | |

* cited by examiner

ELECTRONIC INSTRUMENT AND METHOD FOR USING SAME

CROSS-REFERENCE TO RELATED APPLICATION

The present application is a Continuation-in-Part of International Patent Application No. PCT/IB2015/056992, filed Sep. 11, 2015. PCT/IB2015/056992 claims priority to the filing date of Canadian Patent Application No. 2,887,490, filed Apr. 8, 201. The subject matter of PCT/IB2015/056992 and Canadian Patent Application No. 2,887,490 is incorporated herein by reference in its entirety.

FIELD

The invention relates to electronics. More precisely, the invention pertains to an electronic instrument and a method for using same.

BACKGROUND

Electronic instruments are of great advantages since they usually offer greater possibilities than the non-electronic ones in term of sound generated. This is due to the fact that the sound may be manipulated before it is generated.

Unfortunately, many electronic instruments suffer from various drawbacks.

For instance, in one case, they are simply an electronic version of the existing non-electronic instruments such as, for instance, in the case of an electric guitar.

In some other cases, the configuration of the electronic instrument may be cumbersome to perform.

In other cases, the electronic instrument may be bulky.

There is a need for an electronic instrument that will overcome at least one of the above-identified drawbacks.

Features of the invention will be apparent from review of the disclosure, drawings and description of the invention below.

BRIEF SUMMARY

According to a broad aspect, there is disclosed an electronic instrument comprising an elongated member comprising at least one strap; a plurality of detectors aligned in the elongated member, each detector for detecting a finger-sized object in the vicinity thereof and for providing a corresponding signal; wherein the plurality of detectors comprises a plurality of proximity sensor cells mounted on the at least one strap and a processing unit operatively connected to the plurality of detectors, the processing unit for receiving the signals from the plurality of detectors and for generating a signal indicative of a sound to generate; wherein the processing unit is located inside the elongated member.

According to one embodiment, the elongated member comprises at least one strap and a plurality of proximity sensor cells mounted on the at least one strap.

According to one embodiment, the elongated member comprises more than one strap, each strap of the more than one strap comprising sensor cells, wherein the more than one strap are connected together using a data bus.

According to another embodiment, the plurality of proximity sensor cells comprises infrared proximity sensor cells.

According to an embodiment, the at least one strap is flexible.

According to another embodiment, the elongated member comprises a slot extending on the surface of the elongated member and further wherein the electronic instrument comprises a transparent medium inserted in the slot such as that plurality of sensors is located inside the elongated member behind the transparent medium.

According to an embodiment, the transparent medium is selected from a group consisting of a plastic member and a flexible plastic tube.

According to an embodiment, the electronic instrument further comprises an input/output device operatively connected to the processing unit, the input/output device for obtaining an input from a user, the processing unit further receives an input signal and generates a signal indicative of a sound to generate using the signals from the plurality of detectors and the input from the user.

According to an embodiment, the input/output device is further used for providing data originating from the processing unit to a device operatively connected to the electronic instrument via the input/output device.

According to an embodiment, the data originating from the processing unit comprises data representative of the signals from the plurality of detectors.

According to an embodiment, the data originating from the processing unit comprises the signal indicative of a sound to generate, further wherein the device operatively connected to the electronic instrument via the input/output device comprises a sound generating unit receiving the signal indicative of a sound to generate and generating the sound accordingly.

According to an embodiment, the input/output device further receives a signal from a remote device, the processing unit receives the signal from the device and generates a signal indicative of a sound to generate using at least the signals from the plurality of detectors, the input from the user and the signal from the device.

According to an embodiment, the remote device comprises another plurality of detectors.

According to an embodiment, the input from the user comprises at least one of a user-defined script.

According to an embodiment, the input/output unit further comprises an accelerometer providing accelerometer data, the signal indicative of a sound to generate is generated using the accelerometer data.

According to an embodiment, the input from the user comprises at least a configuration file comprising a plurality of configurations, the input/output device comprises a configuration selector for selecting one of the plurality of configurations.

According to an embodiment, the input/output device comprises a LED indicator for providing an indication of a status of the electronic instrument.

According to another embodiment, the input/output device comprises at least one effect data selector, each of the at least one effect data selector for providing a corresponding effect data and the sound to generate is generated using the at least one corresponding effect data.

According to an embodiment, the elongated member has a cylindrical shape.

According to an embodiment, the elongated member is made of a material selected from a group consisting of aluminum, plastic, carbon fiber and a clear to infrared impact resistant polycarbonate.

According to a broad aspect, there is disclosed a method for using an electronic instrument, the method comprising calibrating the electronic instrument; selecting a configuration and playing with the electronic instrument.

According to an embodiment, the calibration of the electronic instrument comprises selecting a "zero calibration" mode; performing a "zero calibration", said "zero calibration" for defining a first distance such that if an object is detected by a first given detector of the plurality of detectors at a distance greater than the first distance, the value of the first given detector will be set to be zero; selecting a "full calibration;" and performing the "full calibration," said "full calibration" for defining a second distance such that if an object is detected by a second given detector of the plurality of detectors at a distance shorter than the second distance, the value of the second given detector will be set to be a maximum value.

According to an embodiment, the performing of the "zero calibration" is performed by providing a planar object at the first distance from the plurality of detectors; further wherein the "full calibration" is performed by providing the planar object at the second distance from the plurality of detectors.

BRIEF DESCRIPTION OF THE DRAWINGS

In order that the invention may be readily understood, embodiments of the invention are illustrated by way of example in the accompanying drawings.

Figure 1:
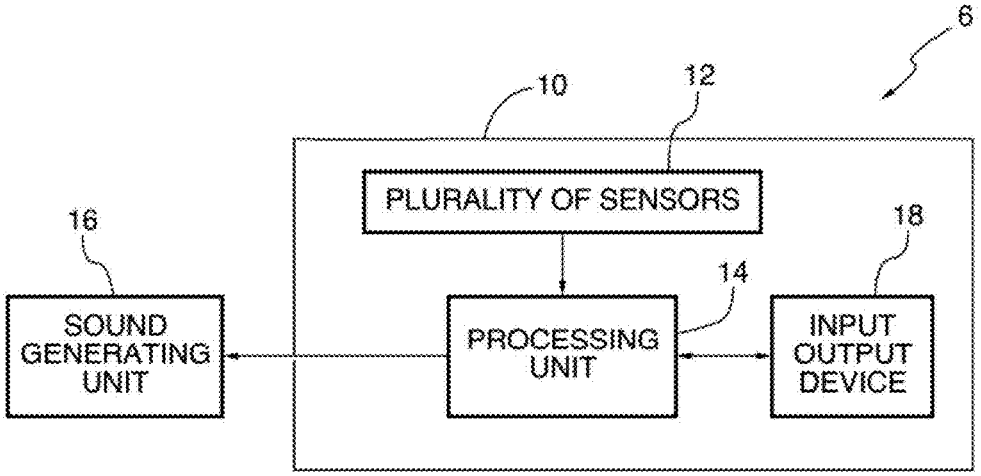
FIG. 1 is a block diagram which shows an embodiment of an electronic instrument. The electronic instrument comprises, inter alia, a plurality of sensors, a processing unit and an input output device.

Further details of the invention and its advantages will be apparent from the detailed description included below.

DETAILED DESCRIPTION

In the following description of the embodiments, references to the accompanying drawings are by way of illustration of an example by which the invention may be practiced.

Terms

The term "invention" and the like mean "the one or more inventions disclosed in this application," unless expressly specified otherwise.

The terms "an aspect," "an embodiment," "embodiment," "embodiments," "the embodiment," "the embodiments," "one or more embodiments," "some embodiments," "certain embodiments," "one embodiment," "another embodiment" and the like mean "one or more (but not all) embodiments of the disclosed invention(s)," unless expressly specified otherwise.

A reference to "another embodiment" or "another aspect" in describing an embodiment does not imply that the referenced embodiment is mutually exclusive with another embodiment (e.g., an embodiment described before the referenced embodiment), unless expressly specified otherwise.

The terms "including," "comprising" and variations thereof mean "including but not limited to," unless expressly specified otherwise.

The terms "a," "an" and "the" mean "one or more," unless expressly specified otherwise.

The term "plurality" means "two or more," unless expressly specified otherwise.

The term "herein" means "in the present application, including anything which may be incorporated by reference," unless expressly specified otherwise.

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

The term "e.g." and like terms mean "for example," and thus do not limit the terms or phrases they explain. For example, in a sentence "the computer sends data (e.g., instructions, a data structure) over the Internet," the term "e.g." explains that "instructions" are an example of "data" that the computer may send over the Internet, and also explains that "a data structure" is an example of "data" that the computer may send over the Internet. However, both "instructions" and "a data structure" are merely examples of "data," and other things besides "instructions" and "a data structure" can be "data."

The term "i.e." and like terms mean "that is," and thus limit the terms or phrases they explain.

Neither the Title nor the Abstract is to be taken as limiting in any way as the scope of the disclosed invention(s). The title of the present application and headings of sections provided in the present application are for convenience only, and are not to be taken as limiting the disclosure in any way.

Numerous embodiments are described in the present application, and are presented for illustrative purposes only. The described embodiments are not, and are not intended to be, limiting in any sense. The presently disclosed invention (s) are widely applicable to numerous embodiments, as is readily apparent from the disclosure. One of ordinary skill in the art will recognize that the disclosed invention(s) may be practiced with various modifications and alterations, such as structural and logical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

With all this in mind, the present invention is directed to an electronic instrument and a method for using same.

Now referring to FIG. 1, there is shown an embodiment of an electronic instrument 6.

The electronic instrument 6 comprises an elongated member 10. The elongated member 10 comprises a plurality of sensors 12, a processing unit 14 and an input/output device 18. The electronic instrument 6 is operatively connected to a sound generating unit 16.

The plurality of sensors 12 is used for detecting a finger-sized object in the vicinity thereof and for providing a corresponding signal to the processing unit 14. It will be appreciated that a plurality of finger-sized objects can be detected simultaneously in one embodiment. In fact and in one embodiment, up to four (4) finger-sized objects can be detected. The skilled addressee will appreciate that various embodiments may be provided for the plurality of sensors 12 as further explained below.

The processing unit 14 is operatively connected to the input/output device 18, to the plurality of sensors 12 and to the sound generating unit 16. The processing unit 14 is used for generating a signal indicative of a sound to generate using at least the signal provided by the plurality of sensors 12. The signal indicative of a sound to generate is provided to the sound generating unit 16. It will be appreciated by the skilled addressee that various embodiments of the processing unit 14 may be provided.

The sound generating unit 16 is operatively connected to the processing unit 14 of the electronic instrument 6, and receives the signal indicative of a sound to generate and generates a sound accordingly. In one embodiment, the signal indicative of a sound to generate is a MIDI signal. It will be appreciated by the skilled addressee that various embodiments of the sound generating unit 16 may be provided. In one embodiment, the sound generating unit 16 comprises a processing device operatively connected to the processing unit 14. It will be appreciated that the processing device may be operatively connected to the sound generating unit 16 using a wireless connection provided by a short range wireless network in one embodiment. For instance, the wireless connection may be provided using a Bluetooth™ connection. Moreover, it will be appreciated that the processing device of the sound generating unit 16 may be of various types. In one embodiment, the processing device comprises a smartphone, such as an Apple™ Iphone, running an application suitable for receiving the signal indicative of a sound to generate and for generating it. In an alternative embodiment, the processing device is a laptop, such as a macbook manufactured by Apple™ and running an application suitable for receiving the signal indicative of a sound to generate and for generating it. The skilled addressee will appreciate that various alternative embodiment of the sound generating unit 16 may be provided.

It will be appreciated that each of the plurality of sensors 12, the processing unit 14 and the input/output device 18 is located in the elongated member 10. As explained further below, it will be appreciated that the elongated member 10 may have various shapes and sizes.

Figure 2:
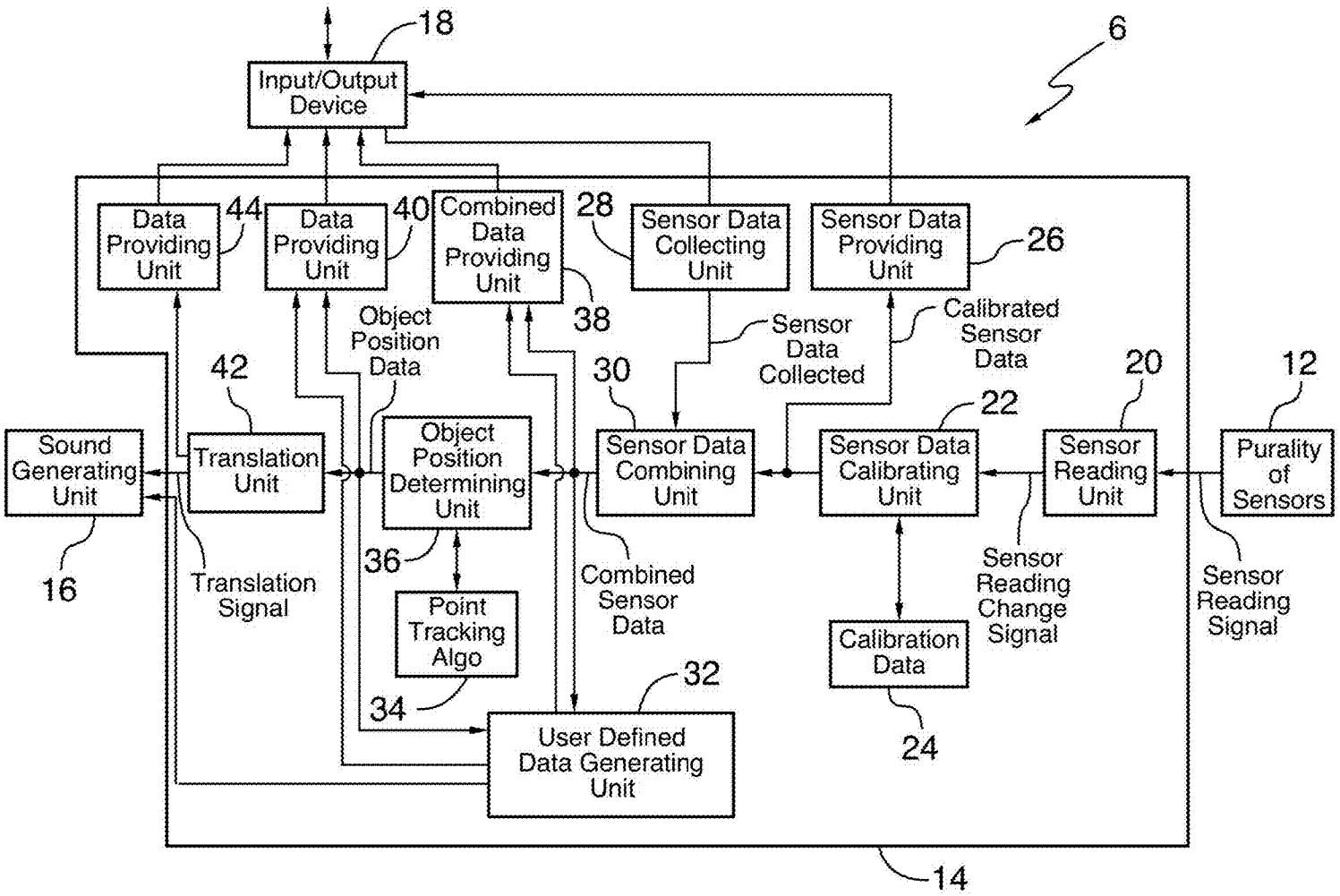
FIG. 2 is a block diagram which shows an embodiment of an electronic instrument and details the various components of the processing unit.

Now referring to FIG. 2, there is shown an embodiment of the electronic instrument 6 and, more precisely, of the components of the processing unit 14.

As mentioned above, the processing unit 14 is operatively connected to the input/output device 18, to the plurality of sensors 12 and to the sound generating unit 16.

More precisely, and in the embodiment shown in FIG. 2, the processing unit 14 comprises a sensor reading unit 20, a sensor data calibrating unit 22, calibrating data 24, a sensor data providing unit 26, a sensor data collecting unit 28, a sensor data combining unit 30, a user-defined data generating unit 32, a point tracking algorithm unit 34, an object position determining unit 36, a combined data providing unit 38, a data providing unit 40, a translation unit 42, and a data providing unit 44. In one embodiment, the processing unit 14 comprises a NXP Cortex-M4 LPC4088 microcontroller in BGA package mounted on an embedded Artist LPC4088 Quickstart board with a program Flash of 8 MB QSPI+512 kB on-chip and 32 MB SDRAM with 96 kB on-chip SRAM and 4 kB on-chip E2PROM and MCP2551-I/SN added on board.

The sensor reading unit 20 is used for reading the plurality of sensors 12 and for providing sensor reading change signals. More precisely, the sensor reading unit 20 performs a filtering to provide only values of sensor reading that have changed more than a given sensitivity threshold. In one embodiment, the plurality of sensors 12 comprises two (2) straps, each comprising sixteen (16) infrared proximity measurement cells mounted thereon. Each of the plurality of infrared proximity measurement cells comprises a VCNL 4000 manufactured by Vishay™. It will be appreciated that each infrared proximity measurement cell has a resolution of sixteen (16) bits which with the detection algorithm disclosed herein enables a precise positioning in the plane of a given finger-sized object. The sensor reading unit 20 therefore receives a sensor reading signal from the plurality of sensors 12 and provides a sensor reading change signal. In one embodiment, the sensor reading signal comprises a table comprising reading from every managed infrared proximity measurement cell together with an indication of the first cell in the table. Still in one embodiment, the sensor reading change signal comprises a table with values of the sensors that have changed more than a given sensitivity threshold together with a matrix position.

It will be appreciated that one advantage of the infrared proximity measurement cell used in this embodiment is that it enables a low-power consumption. This is possible thanks to the use of short infrared pulses used rather than a continuously powered infrared emitter.

Also, it has been contemplated that the pulse modulation used may improve immunity to external infrared sources. As a consequence, the modulation frequency has been chosen to be outside lighting typical operating ranges.

The sensor data calibrating unit 22 is used for calibrating data originating from the plurality of sensors 12. The calibration is performed using calibration data 24. More precisely, the sensor data calibrating unit 22 receives sensor reading change signals from the sensor reading unit 20, uses data obtained from the calibration data 24, and provides calibrated sensor data. The calibrated sensor data is provided to the sensor data providing unit 26 and to the sensor data combining unit 30. It will be appreciated that the calibrated sensor data provided to the sensor data providing unit 26 may be further provided to the input/output device 18. In such embodiment, the calibrated sensor data is used by a remote processing unit operatively connected to the electronic instrument 6 via the input/output device 18 using a CAN bus port in one embodiment.

The sensor data collecting unit 28 is operatively connected to the input/output device 18. More precisely, the sensor data collecting unit 28 is used for obtaining sensor data from a remote location via the input/output device 18 using a CAN bus port in one embodiment. The sensor data collected are provided by the sensor data collecting unit 28 to the sensor data combining unit 30. The skilled addressee will appreciate that the use of the sensor data providing unit 26 and the sensor data collecting unit 28 enables the number of infrared proximity measurement cells to be expanded.

The sensor data combining unit 30 is used for combining the sensor data received from the sensor data collecting unit 28 with the calibrated sensor data provided by the sensor data calibrating unit 22. The combined sensor data is provided to the user-defined data generating unit 32, to the object position determining unit 36, and to the combined data providing unit 38.

The combined data providing unit 38 is used for receiving the combined sensor data from the sensor data combining unit 30 and for providing the combined data to the input/output device 18. The combined sensor data may then be provided to a remote processing unit operatively connected with the input/output device 18. In one embodiment, the combined data providing unit 38 comprises a USB serial point driver. The USB serial port driver may be advantageously used to provide raw data.

The object position determining unit 36 is used for determining a position of an object using a tracking algorithm 34 and the combined sensor data. The object position data generated by the object position determining unit is provided to the data providing unit 40, to the translation unit 42, and to the user-defined data generating unit 32. In one embodiment, the object position data comprises an x, y, z position of a tracked object, an object identifier and an event indicating if the object was newly created, if the object has a new position and if the object was removed from a tracking pool.

It will be appreciated that the data providing unit 40 is used for providing the object position data to the input/output device 18. The data providing unit 40 may further provide data received from the user-defined generating unit 32 in response to the providing of the object position data. Such data may be then provided to the input/output device 18. In one embodiment, the data providing unit 40 comprises a USB joystick driver. In such embodiment, the electronic instrument 6 may be used as a joystick for a game executed on a remote processing unit operatively connected to the electronic instrument via the USB joystick driver.

The translation unit 42 is used for translating the object position data provided by the objection position determining unit into a translated signal. In one embodiment, the translated signal is provided to the data providing unit 44 and to the sound generating unit 16. In one embodiment, the translated signal comprises a midi signal. It will be appreciated that the midi signal may be generated according to various embodiments. In one embodiment, the midi signal is generated according to a configuration selected. Still in this embodiment, three configurations are available. A first configuration is referred to a digital string configuration. A second configuration is referred to as a synthesizer configuration and a third configuration is referred to as a pitch wheel configuration. Various alternative configurations may be defined in the translation unit 42 depending on an application sought. For instance, in the synthesizer mode, a given frequency is assigned to each infrared proximity measurement cell. In the digital string configuration, two frequencies are defined, each of which is assigned with one of the first infrared proximity measurement cell and the last infrared proximity measurement cell. It will be appreciated that a frequency is associated with a position between the first infrared proximity measurement cell and the last infrared proximity measurement cell.

The data providing unit 44 is used for providing the translated signal to the input/output device 18. The translation signal may then be provided to a remote processing unit operatively connected to the input/output device 18. Still in one embodiment, the data providing unit 44 comprises a midi driver.

As mentioned above, the sound generating unit 16 is used for generating a sound using the translated signal. It will be appreciated that the sound generating unit 16 may also receive in one embodiment a signal provided by the user-defined data generating unit 32. In one embodiment, the sound generating unit 16 comprises a PJRC Teensy 3.1 electronic board comprising a Freescale MK20DX256VLH7 Cortex-M4 96 MHz processor and a Sparkfun Teensy Audio Board DEV-12767 mounted on the processor.

While this is not disclosed in FIG. 2, it will be appreciated that in the case where the sound generating unit 16 is not located in the electronic instrument 6, i.e. in the case where the electronic instrument 6 is operatively connected to a sound generating unit 16, the sound generated using 16 is operatively connected to the electronic instrument via the input/output device 18.

The user-defined data generating unit 32 is used for generating data according to a script. It will be appreciated that the script may use various types of data such as, for instance, acceleration data. In one embodiment, the script is a user-defined script.

Figure 3A:
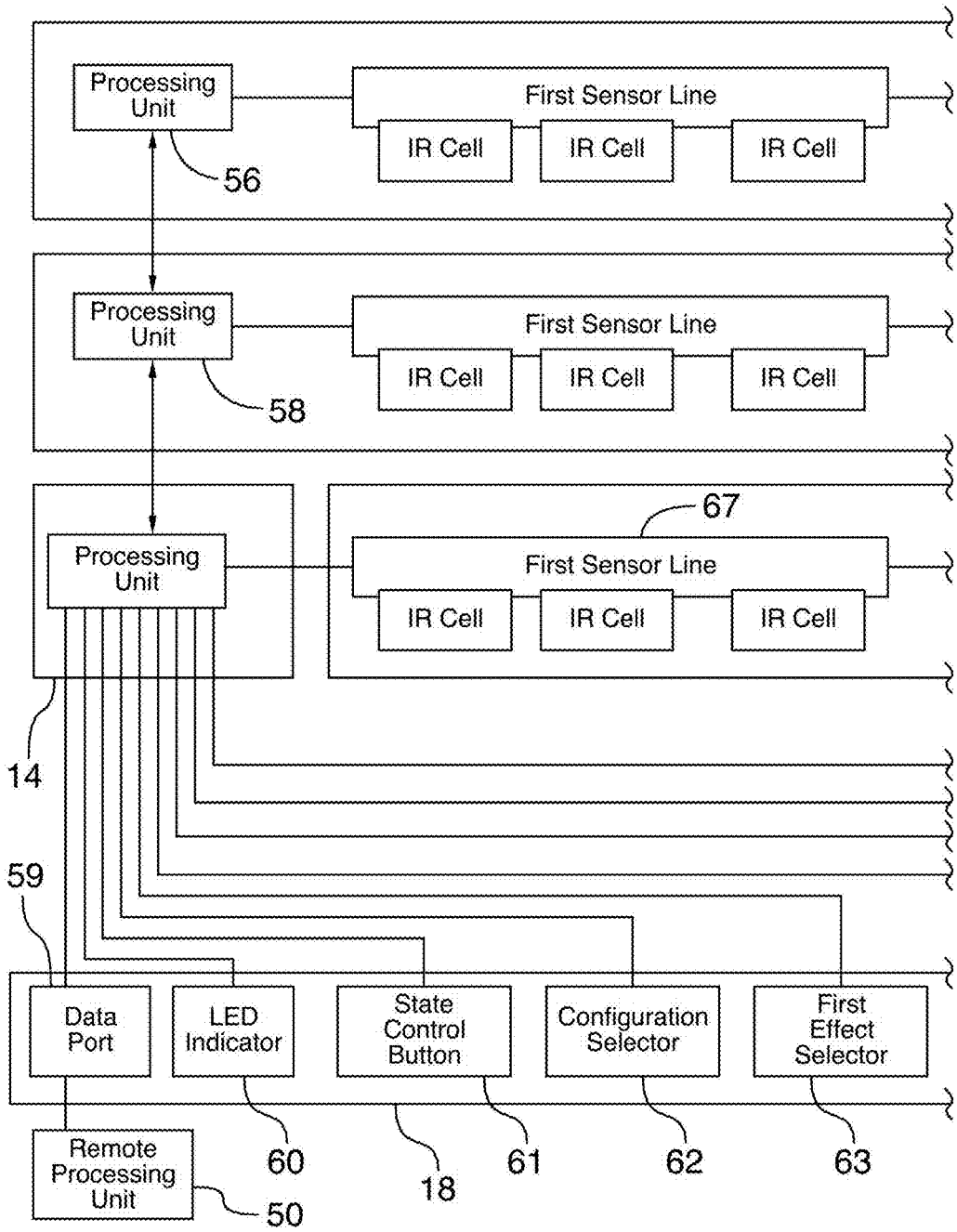
FIGS. 3A, 3B, 3C are block diagrams which illustrate, inter alia, the various components of the input output device.
Figure 3B:
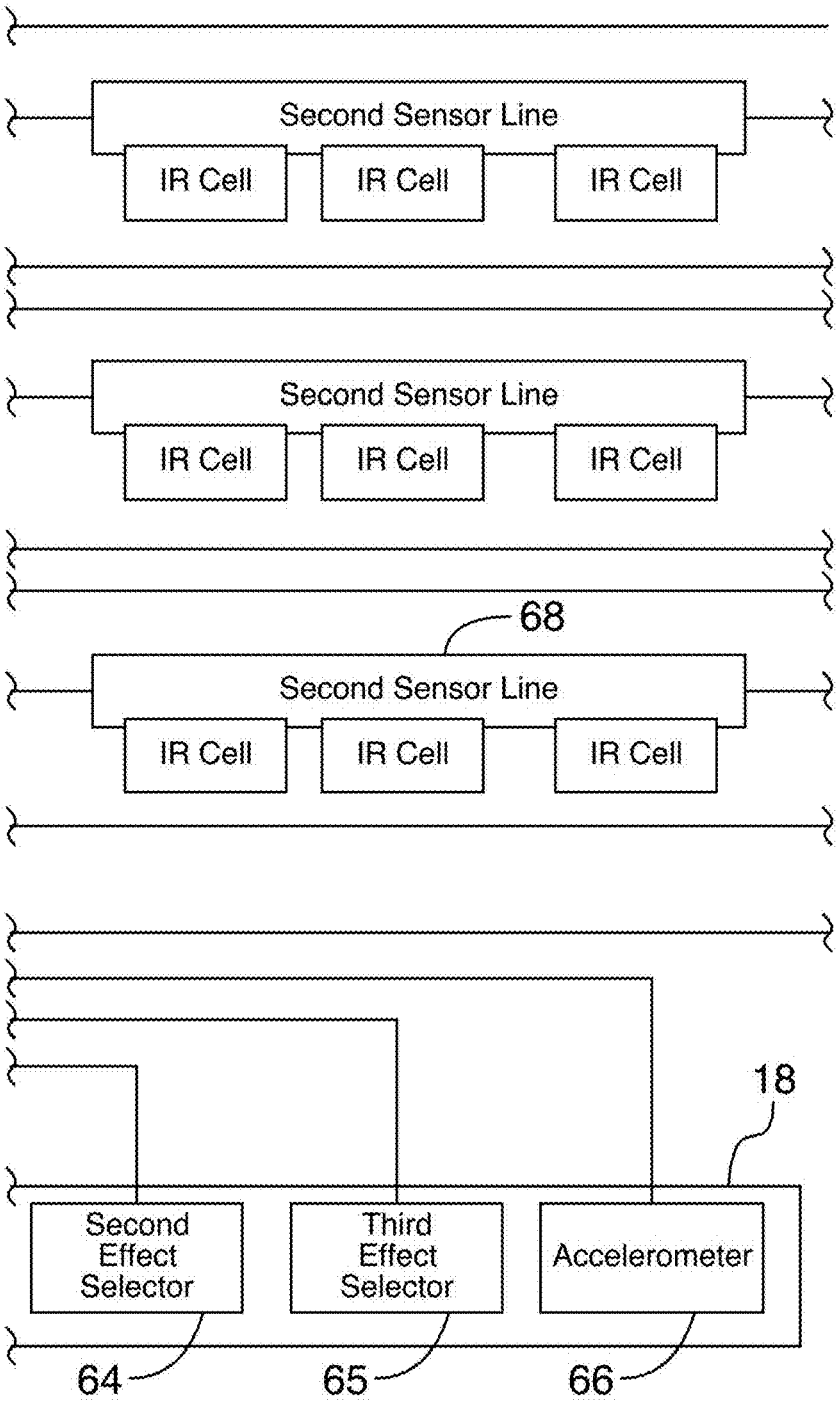
Figure 3C:
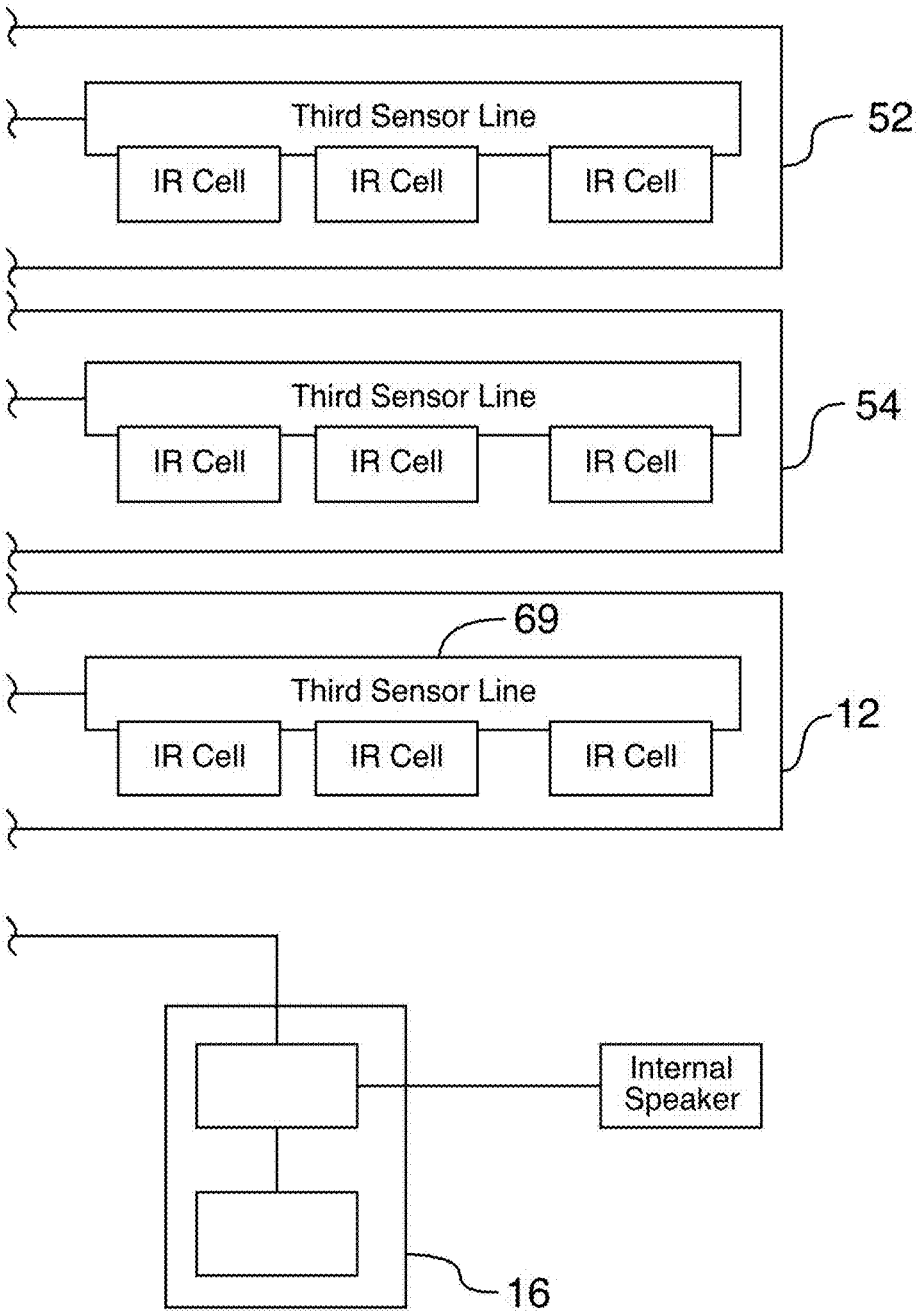

Now referring to FIGS. 3A, 3B and 3C, there is shown a diagram that details the electronic instrument 6 and, more precisely, the plurality of sensors 12 and the input/output device 18.

More precisely, and as shown in FIGS. 3A, 3B and 3C, the input/output device 18 comprises a data port 59, an LED indicator 60, a state control button 61, a configuration selector 62, a first effect data selector 62, a second effect data selector 64, a third effect data selector 65, and an accelerometer 66. In one embodiment, the accelerometer 66 is a Freescale Semiconductor MMA8451Q accelerometer chip. The skilled addressee will appreciate that various alternative embodiments may be provided for the input/output device 18.

More precisely, the data port 59 is used for enabling a communication between the electronic instrument 6 and a remote device such as a desktop computer. It will be appreciated that in one embodiment, the data port 59 is also used to provide electrical energy to the electronic instrument 6. In one embodiment, the communication comprises transmitting to the electronic instrument 6 a configuration file for the electronic instrument 6. In one embodiment, the data port 59 comprises a USB port. The skilled addressee will appreciate that various alternative embodiments may be provided for the data port 59.

The LED indicator 60 is used for providing a visual indication representative of a status or function of the electronic instrument 6. The visual indication may be selected from a group consisting of a "steady light" signal, a "slow blink" light signal, a "fast blink" light signal, a "very fast blink" signal and a "no light" signal. The skilled addressee will appreciate that various alternative embodiments may be provided for the LED indicator 60.

The state control button 61 is used for selecting a state for the electronic instrument 6. It will be appreciated that the electronic instrument 6 may be in various states.

More precisely and in one embodiment, the electronic instrument 6 may be in a "normal use" state if the state control button 61 is not pressed. Still in this embodiment, the electronic instrument 6 may enter a may be in a "reset/reload" state if the state control button 61 is pressed for a duration comprised between 1 s and 4.99 s and then released.

The LED indicator 60 will provide a "slow blink light" signal if the state control button 61 is pressed for a duration comprised between 1 s and 4.99 s. The electronic instrument 6 may enter an "Idle" state if the state control button 61 is pressed for a duration comprised between 5 s and 9.99 s and is then released. The LED indicator 60 may provide a "steady light" signal if the state control button 61 is pressed for a duration comprised between 5 s and 9.99 s. The electronic instrument 6 may enter a "plane sensor zero calibration" state if the state control button 61 is pressed for a duration comprised between 10 s and 14.99 s and is then released. The LED indicator 60 may provide a "fast blink light" signal if the state control button 61 is pressed for a duration comprised between 10 s and 14.99 s. The electronic instrument 6 may enter a "plane sensor full calibration" state if the state control button 61 is pressed for a duration comprised between 15 s and 19.99 s and is then released. The LED indicator 60 may provide a "very fast blink light" signal if the state control button 61 is pressed for a duration comprised between 15 s and 19.99 s. The electronic instrument 6 may enter an "Idle" state if the state control button 61 is pressed for a duration comprised between 20 s and 59.99 s and is then released. The LED indicator 60 may provide a "steady light" signal if the state control button 61 is pressed for a duration comprised between 20 s and 59.99 s. Finally, the electronic instrument 6 may enter a "Reset to factory" state if the state control button 61 is pressed for a duration greater than 60 s and is then released. The LED indicator 60 may provide a "no light" signal if the state control button 61 is pressed for a duration greater than 60 s. The skilled addressee will appreciate that various alternative embodiments may be possible for the state control button 61 and its operation.

The configuration selector 62 is used for selecting a configuration for the electronic instrument. In one embodiment, the configuration selector 62 comprises a knob button having eight (8) possible positions. The skilled addressee will appreciate that various alternative embodiments may be provided for the configuration selector 62.

Still in one embodiment, the first position of the configuration selector 62 is used for selecting a "digital string" configuration. The "digital string" configuration is a configuration in which the electronic instrument 6 may be played as a digital string.

In this embodiment, the second position of the configuration selector 62 is used for selecting a "pitch wheel" configuration. The "pitch wheel" configuration is a configuration in which the electronic instrument 6 may be played as a pitch wheel.

In this embodiment, the third position of the configuration selector 62 is used for selecting a first user-defined configuration comprising a user-defined script. In fact, the first user-defined configuration is a configuration in which the electronic instrument 6 may be played using data located in the first user-defined configuration file. It will be further appreciated that the user-defined scripts are contained in the user-defined configuration. The first user-defined configuration file may be uploaded to the electronic instrument 6 via the input/output device 18.

In this embodiment, the fourth position of the configuration selector 62 is used for selecting a second user-defined configuration. The second user-defined configuration is a configuration in which the electronic instrument 6 may be played using data located in the second user-defined configuration file. The second user-defined configuration file may be uploaded to the electronic instrument 6 via the input/output device 18.

In this embodiment, the fifth position of the configuration selector 62 is used for selecting a third user-defined configuration. The third user-defined configuration is a configuration in which the electronic instrument 6 may be played using data located in the third user-defined configuration file. The third user-defined configuration file may be uploaded to the electronic instrument 6 via the input/output device 18.

In this embodiment, the sixth position of the configuration selector 62 is used for selecting a fourth user-defined configuration. The fourth user-defined configuration is a configuration in which the electronic instrument 6 may be played using data located in the fourth user-defined configuration file. The fourth user-defined configuration file may be uploaded to the electronic instrument 6 via the input/output device 18.

In this embodiment, the seventh position of the configuration selector 62 is used for selecting a fifth user-defined configuration. The fifth user-defined configuration is a configuration in which the electronic instrument 6 may be played using data located in the fifth user-defined configuration file. The fifth user-defined configuration file may be uploaded to the electronic instrument 6 via the input/output device 18.

In this embodiment, the eighth position of the configuration selector 62 is used for selecting a sixth user-defined configuration. The sixth user-defined configuration is a configuration in which the electronic instrument 6 may be played using data located in the sixth user-defined configuration file. The sixth user-defined configuration file may be uploaded to the electronic instrument 6 via the input/output device 18.

The skilled address will appreciate that various alternative embodiments may be possible for the configuration selector 62.

It will be appreciated that having a single configuration selector 62 for switching between the various configurations is of great advantage for switching quickly between the various configurations during a live performance, for instance.

The first effect data selector 63 is used for selecting an output volume for the sound generated by the electronic instrument 6.

The second effect data selector 64 is used for performing a panning of the sound generated by the electronic instrument 6.

The third effect data selector 65 is used modifying the balance of the sound generated by the electronic instrument 6. In fact, it will be appreciated that each of the first effect data selector 63, the second effect data selector 64 and the third effect data selector 65 is mapped to a specific standardized midi control message in the user-defined configuration.

The accelerometer 66 is used for providing acceleration data representative of user induced vibrations. The acceleration data may be used when playing with the electronic instrument 6 for generating MIDI control messages.

Each of the data ports 59, the LED indicator 60, the state control button 61, the configuration selector 62, the first effect data selector 63, the second effect data selector 64, the third effect data selector 65 and the accelerometer 66 is operatively connected to the processing unit 14.

Still referring to FIGS. 3A, 3B and 3C, it will be appreciated that the plurality of sensors 12 comprises, in one embodiment, a first sensor line 67, also referred to above as a strap, a second sensor line 68, also referred to above as a strap, and a third sensor line 69, also referred to above as a strap.

Each of the first sensor line 67, the second sensor line 68 and the third sensor line 69 comprises a plurality of infrared proximity measurement cells secured on a corresponding strap. In one embodiment, each of the first sensor line 67, the second sensor line 68 and the third sensor line 69 comprises sixteen (16) infrared proximity measurement cells. The skilled addressee will appreciate that various alternative embodiments may be provided.

In addition, it will be appreciated that the first sensor line 67 is operatively connected to the second sensor line 68 via an infrared proximity measurement cell bus, which is one embodiment of a data bus. Similarly, the second sensor line 68 is operatively connected to the third sensor line 69 via an infrared proximity measurement cell bus. It will be appreciated that in one embodiment, the infrared proximity measurement cell bus comprises a I2C bus.

It will be appreciated that in the embodiment shown in FIGS. 3A, 3B and 3C, additional infrared proximity measurement cells may be operatively connected to the electronic instrument 6. More precisely, the processing unit 14 is operatively connected to another processing unit 58 responsible for providing to the processing unit 14 infrared proximity measurement cell data originating from a corresponding first sensor line operatively connected to a corresponding second sensor line and operatively connected to a third sensor line. This additional module is referred to as module 54.

A second additional module, referred to as additional module 52, is also operatively connected to the processing unit 14 and in used for providing infrared proximity measurement cell data. In one embodiment, the additional module 52 is connected to the processing unit 14 via a CAN bus and the module 54 is connected to the additional module 52 via a CAN bus. In this embodiment, the second additional module 52 comprises a processing unit 56 operatively connected to a corresponding first sensor line, a corresponding second sensor line and a corresponding third sensor line. Each of the first sensor line, the corresponding second sensor line and the corresponding third sensor line comprises a plurality of infrared proximity measurement cells.

It will be appreciated that the processing units 56 and 58 may be of various types. In one embodiment the processing units 56 and 58 comprise a LPC4088 with 8 MB QSPI with 512 kB on-chip and 32 MB. Alternatively, a Freescale FRDM-K64F (http://www.freescale.com/webapp/sps/site/prod_summary.jsp?code=FRDM-K64F) may be used. An advantage of using the processing units 56 and 58 is that the infrared proximity measurement cell data may be processed locally. As a consequence, the processing associated with the additional infrared proximity measurement cells is not left to be done by the processing unit 14.

It will be therefore appreciated by the skilled addressee that the number of infrared proximity measurement cells of the electronic instrument 6 may be extended depending on an application sought, which is of great advantage.

Also, it will be appreciated that an advantage of the embodiment disclosed herein is that a matrix of the infrared proximity measurement cells may be created and could extend to miles without the use of repeater, assuming power is provided locally.

Figure 4:
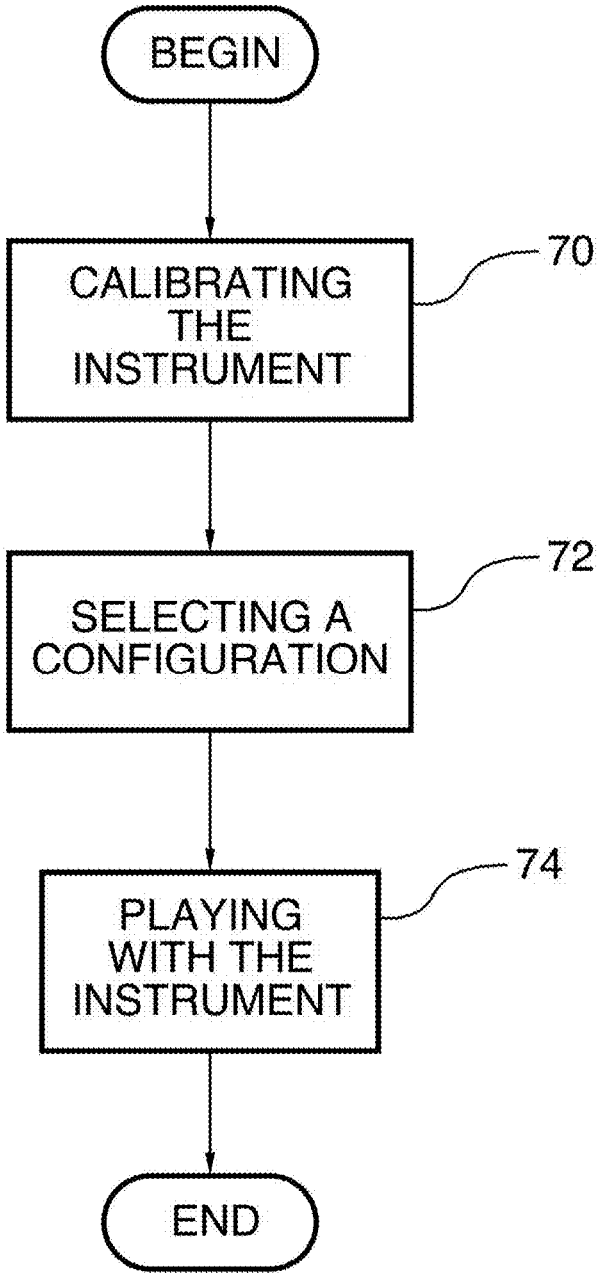
FIG. 4 is a flowchart which shows an embodiment for using the electronic instrument. According to a first processing step, the electronic instrument is calibrated, according to a second processing step, a configuration is selected, and according to a third step, a user is playing the electronic instrument.

Now referring to FIG. 4, there is shown an embodiment for using the electronic instrument 6.

According to processing step 70, the electronic instrument 6 is calibrated.

Figure 5:
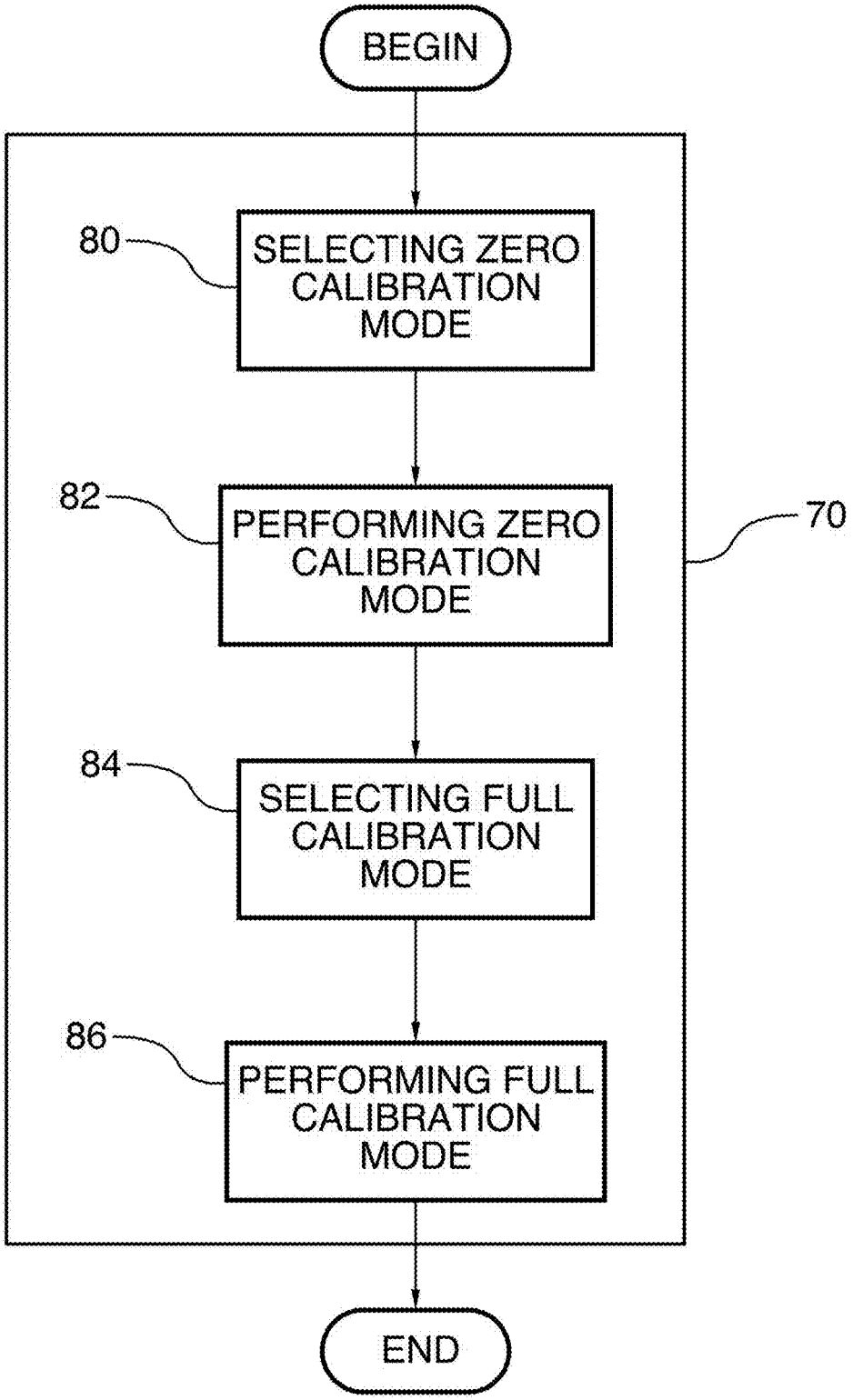
FIG. 5 is a flowchart which shows an embodiment for calibrating the electronic instrument.

Now referring to FIG. 5, there is shown an embodiment for calibrating the electronic instrument 6.

According to processing step 80, a "zero calibration" mode is selected.

Figure 6:
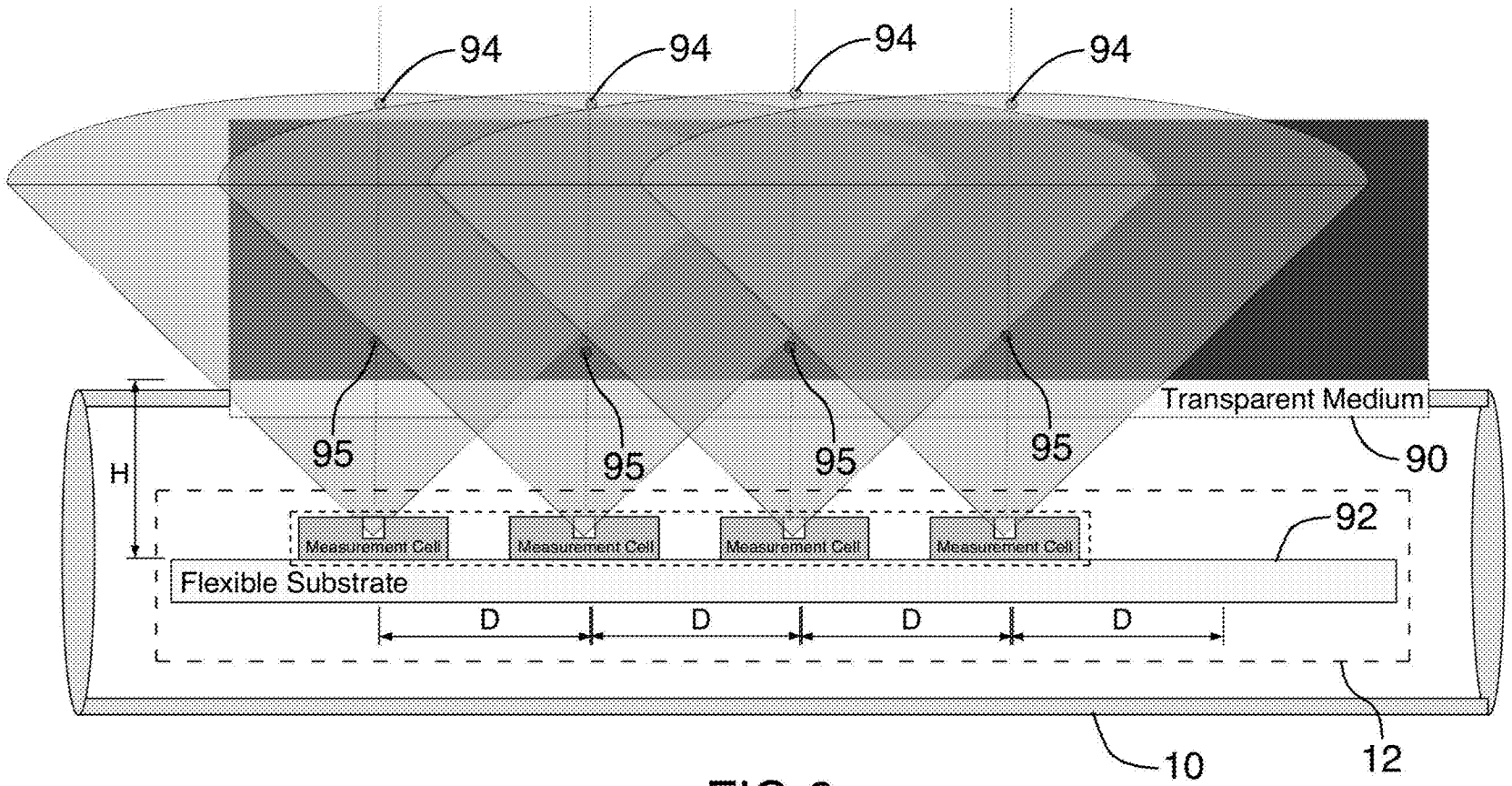
FIG. 6 is a diagram which illustrates calibration of the electronic instrument using the plurality of sensors.

As shown in FIG. 6, the plurality of sensors 12 is located on a flexible substrate 92, also referred to above as a strap.

The flexible substrate 92 is secured inside the elongated member 10 of the electronic instrument 6. Each proximity measurement cell of the plurality of sensors 12 is capable of measuring a distance to a given point located outside the elongated member 10.

It will be appreciated that in order to achieve that purpose, the elongated member 10 is provided with a transparent medium 90 located in a slot extending on the surface of outer surface of the elongated member 10 and facing the plurality of sensors 12.

A detection is therefore performed outside the electronic instrument 6 through the transparent medium 90.

As shown in FIG. 6, it will be appreciated that each measurement cell of the plurality of sensors 12 has a conic detection shape.

It will be also appreciated that a zero point can be defined as one located at a first given distance from a given infrared proximity measurement cell such that farther than the zero point, the reading of the given infrared proximity measurement cell is assumed to be nil.

Similarly, a maximum point can be defined as one located at a second given distance from a given infrared proximity measurement cell such that at that point or at a distance shorter than the second given distance, the reading of the given infrared proximity measurement cell is considered to be at saturation.

It will be therefore appreciated that the purpose of the calibration process is to set the zero point and the maximum point and to allow a uniform and linear reading plane in the area comprised between the zero point and the maximum point. Still referring to FIG. 6, it will be appreciated that the zero point of a given infrared proximity measurement cell of the plurality of the sensors 12 is referred to by numeral 94, while a maximum point of an infrared proximity measurement cell of the plurality of sensors is referred to using the numeral 95.

In one embodiment, the "zero calibration" mode is selected by pressing the state control button 61 for a duration comprised between 10 s and 14.99 s. The skilled addressee will appreciate that various alternative embodiments may be provided for the selecting of the "zero calibration" mode.

Now referring back to FIG. 5 and according to processing step 82, the zero calibration is performed.

The zero calibration may be performed according to various embodiments.

In one embodiment, the zero calibration is performed by placing the electronic instrument 6 on a plane, measuring slot pointing up and placing an opaque layer at a distance where the sensitivity cut-off is wanted.

Still referring to FIG. 5 and according to processing step 84, a "full calibration mode" is selected.

As mentioned above, the purpose of the full calibration is to define a maximum point located at a second given distance from a given measurement cell such that at that point or at a distance shorter than the second given distance, the reading of the given measurement cell is considered to be at saturation.

In one embodiment, the "full calibration mode" is selected by pressing the state control button 61 for a duration comprised between 15 s and 19.99 s. The skilled addressee will appreciate that various alternative embodiments may be provided for selecting the "full calibration" mode.

According to processing step 86, a "full calibration" mode is performed. It will be appreciated in one embodiment that the performing of the "full calibration" mode comprises placing the electronic instrument 6 on a plane, measuring slot pointing up and placing an opaque layer at the height where the sensitivity saturation is wanted. The skilled addressee will appreciate that various alternative embodiments may be provided for performing the "full calibration" mode.

It will be appreciated that the calibration is fully configurable, meaning that a user may decide to select the zero point and the maximum point where he/she wants.

Now referring back to FIG. 4 and according to processing step 72, a configuration is selected by a user.

As mentioned above, the configuration may be selected from a group consisting of a "digital string" configuration, "a pitch wheel" configuration, a first user-defined configuration, a second user-defined configuration, a third user-defined configuration, a fourth user-defined configuration, a fifth user-defined configuration and a sixth user-defined configuration.

Still in this embodiment and as mentioned above, the configuration is selected using the configuration selector 62.

According to processing step 74, a user is playing the electronic instrument 6.

It will be appreciated that the user may play the electronic instrument 6 according to various embodiments. In one embodiment, the electronic instrument 6 is played using fingers which are positioned at a given distance located between the maximum point and the zero point defined. A sound is generated using at least the position of a detected point.

Figure 7:
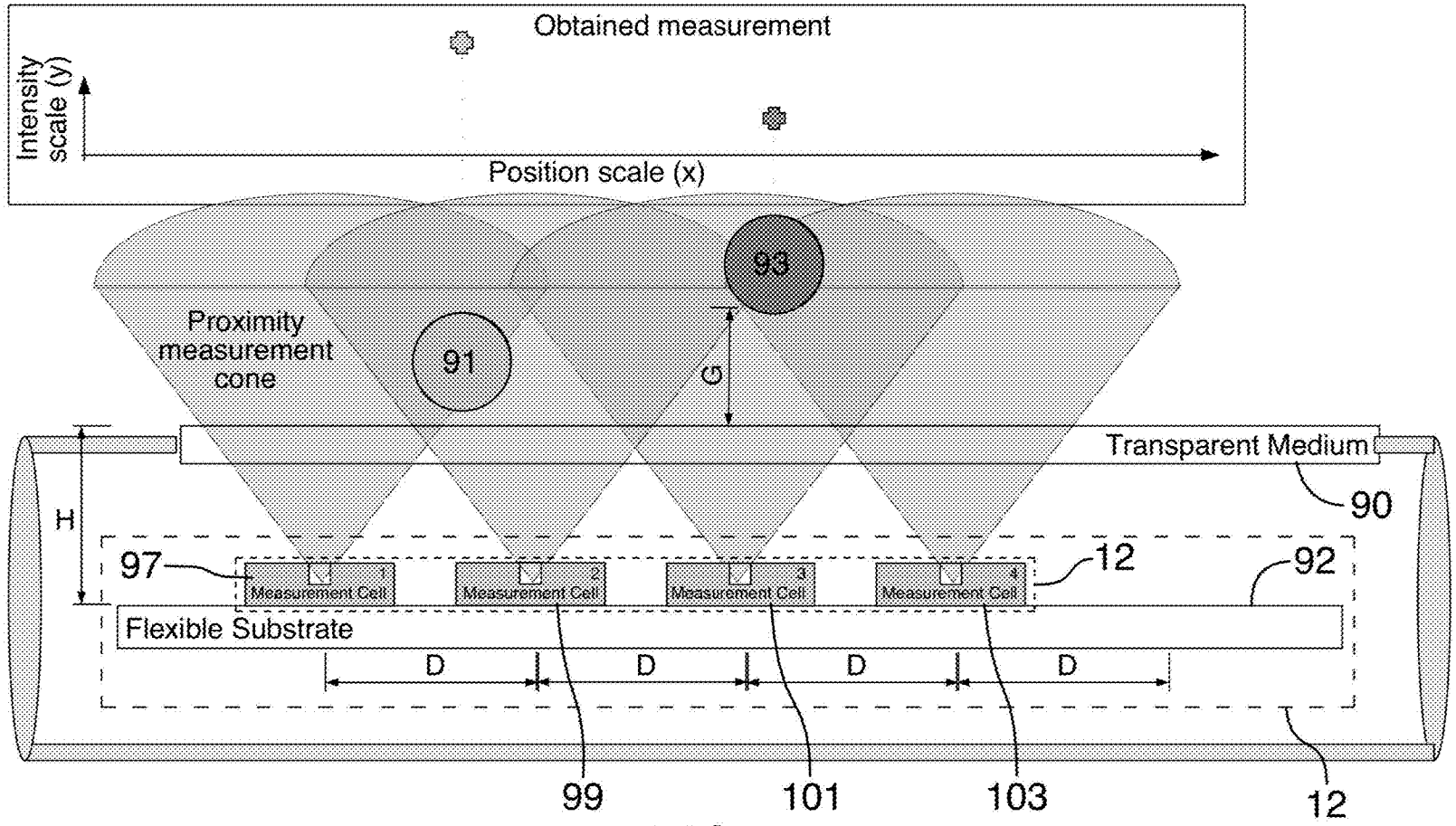
FIG. 7 is a diagram which illustrates how a position is measured using the plurality of sensors.

Now referring to FIG. 7, there is shown how a position is detected using the plurality of sensors 12.

According to a first processing step, proximity sensor cell readings are provided by the plurality of sensors 12.

According to a second processing step, object tracking conditions are evaluated. It will be appreciated that the object tracking conditions are evaluated in a presented order.

More precisely, it will be appreciated that a new tracked object may be created when a given proximity sensor cell has a reading greater than the reading of its direct neighbor proximity sensor cells and the given proximity sensor cell reading is greater than a threshold value and the given proximity sensor cell is not currently linked to an existing tracked object and the direct proximity sensor cell neighbors are not linked to a tracked object. In one embodiment, the value of the threshold is five (5) percent over calibration zero.

Moreover, it will be appreciated that a tracked object may be reassigned a proximity sensor cell when one of currently assigned proximity sensor cell direct neighbor proximity sensor cell became a local maxima. In such case, the tracked object is reassigned to this neighbor proximity sensor cell. The neighbor proximity sensor cell providing the largest value is used if both neighbor proximity sensor cells became local maxima.

In addition, it will be appreciated that a tracked object is removed when a reading of a given proximity sensor cell currently linked to the tracked object goes below the threshold value.

It will be appreciated that a detection of a velocity and aftertouch may be performed. In fact, the detection of a velocity is achieved thanks to a fast scanning of the proximity sensor cells and the detection of the aftertouch is achieved using the fast scanning of the proximity sensor cells and the position tracking.

It will be appreciated that the tracking algorithm operates by maintaining a tracked object for each proximity sensor cell measurement local maximum. In order to allow the measurement of two distinct object positions, there should be two sensor local maximums. For instance, considering a case with objects 91 and 93, the object 91 must be closer to proximity sensor cell 97 than proximity sensor cell 99, and object 93 must be closer to proximity sensor cell 101 than proximity sensor cell 99. In the embodiment shown in FIG. 7, objects 93-91 do not allow two distinct measurements.

It will be appreciated that the providing of the plurality of sensors 12 disclosed herein enables a continuous position measurement on a line. This is possible thanks to the geometry of the plurality of sensors 12 and the tracking algorithm disclosed.

In addition, it will be also appreciated that the electronic instrument 6 disclosed herein also enables a continuous measurement on a two (2) dimension plane. This is possible thanks to the geometry of the plurality of sensors 12 and the tracking algorithm disclosed.

It will be further appreciated that a continuous position measurement may be performed on a curved 2D plane in the case where the plurality of sensors 12 comprises a plurality of proximity sensor cells located on a flexible printed circuit board and the tracking algorithm disclosed herein is used. Such continuous position measurement on a curved 2D plane allows for various shapes for the electronic instrument 6, which can be of great advantage.

It will be further appreciated that a pulse scanning enables an accurate measurement of objects even in elliptical configuration of the measurement straps.

Also, it will be appreciated that the tracking algorithm disclosed herein enables simultaneous multi-object measurements, which is also of great advantage. In fact, and in one embodiment, infrared proximity sensor cells emit very short modulated pulses of infrared wave for which reflection on object is read back. The infrared emitter is powered only during the duration of the pulse. This allows the processing unit of the strap to scan through the infrared proximity sensor cells at a fast pace, without cross-cell measurement interference. The position of multiple points in the measurement plane is tracked by the tracking algorithm disclosed herein.

A short emitted pulse scheme enables fast scan of the proximity sensor cell. In one embodiment, sixteen (16) proximity sensor cells are located on one strap and may be read in about 10 ms.

It will be further appreciated that, in one embodiment, the strap may be sewn on cloth, or cloth-like surface. This may be possible if the strap flexible printing circuit is bordered by sewing space.

Figure 8:
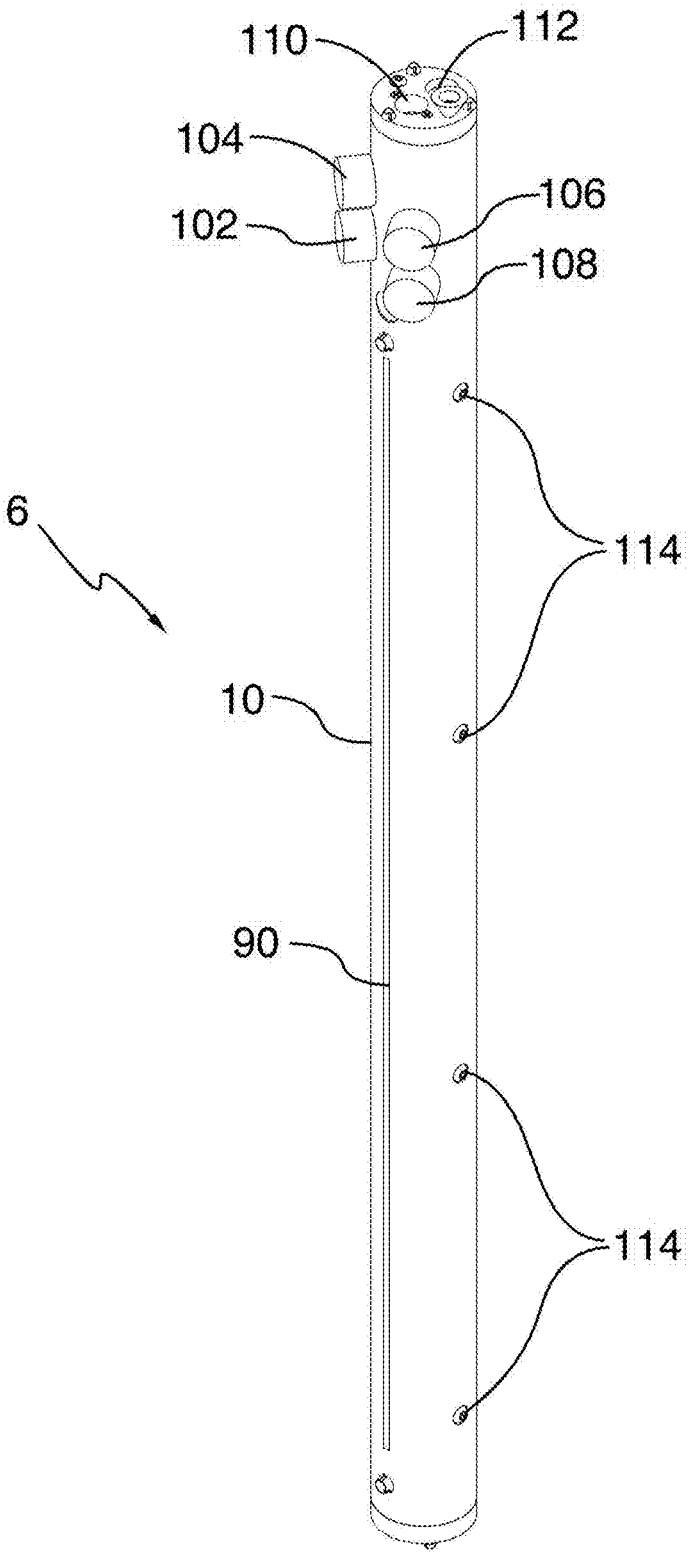
FIG. 8 is a front perspective view of an embodiment of the electronic instrument.

Now referring to FIG. 8, there is shown an embodiment of the electronic instrument 6.

It will be appreciated that, in this embodiment, the elongated member 10 has a cylindrical shape. The skilled addressee will appreciate that various alternative shapes may be provided for the elongated member 10. For instance, the elongated member 10 might have a slightly multi-curved cylindrical shape to reach a more ergonomic shape. Alternatively, the elongated member 10 might have a shape of an half pretzel. The shape of the cylinder aperture may also be adjusted. In fact, instead of having it parallel to the cylinder length, it could be placed with a small angle to the cylinder length to allow the hand of a player to follow a more natural path. All that would need to be done it to angle the aperture and offset a little bit the mounting attachment screw on the cylinder width axis. Also it will be appreciated that the elongated member 10 may be made of various materials such as metal, plastic, carbon fiber, a clear to infrared impact resistant polycarbonate, etc. In one embodiment, the elongated member 10 is made of aluminum 6061T6. In one embodiment, the elongated member 10 has a length of 83 cm and an outside diameter of 2 inches.

A transparent medium 90 is provided on the surface of the elongated member 10 and extends vertically on the surface thereof. It will be appreciated that the plurality of sensors 12 is located behind the transparent medium 90. In one embodiment, the transparent medium 90 is inserted into a slot located on the surface of the elongated member. In one embodiment, the transparent medium 90 is made of a rigid piece of plastic, such as Polycarbonate. It will be appreciated that the transparent medium 90 should provide low attenuation for the infrared cell frequency band in one embodiment. It will be further appreciated that the calibration will allow some compensation for materials having higher attenuation of infrared signals. In an alternative embodiment, the transparent medium 90 comprises a flexible plastic tube inserted inside the slot. It will be appreciated by the skilled addressee that, in this embodiment, the user may obtain a pressure feedback when interacting with the transparent medium due to the resilience of the plastic tube. Such pressure feedback may be of great advantage for the user. Also, it will be appreciated that the transparent medium 90 may be easily replaced by removing it from the slot in which it is engaged. The skilled addressee will appreciate that various alternative embodiments may be provided for the transparent medium 90.

The electronic instrument 6 is further provided with a first rotation member 102, a second rotation member 104, a third rotation member 106 and a fourth rotation member 108.

Each of the first rotation member 102, the second rotation member 104, the third rotation member 106 and the fourth rotation member 108 is used for one of the configuration selector 62, the first effect data selector 63, the second effect data selector 64 and the third effect data selector 65. More precisely and in one embodiment, the fourth rotation member 108 is used for the configuration selector 62. Each of the first rotation member 102, the second rotation member 104 and the third rotation member 106 is used for one of the first effect data selector 63, the second effect data selector 64 and the third effect data selector 65 and the mapping to midi control is defined in one embodiment in a configuration file selected using the configuration selector 62.

The elongated member 10 is further provided with a USB port 110 and an audio jack 112 at one of its extremities. In one embodiment, the audio jack 112 is a stereo audio jack.

The elongated member 10 is further provided with a plurality of securing means 114 that are used for securing the elongated member 10. In one embodiment, the securing means 114 comprises steel posts, such as the ones disclosed at http://www.mcmaster.com/#99637a308/=wgoccv. It will be appreciated that a lateral pressure is applied on the elongated member 10 which allows locking the clear medium 90 in place without obstructing the measurement plane and the electronic instrument holding by the user. The skilled addressee will appreciate that various alternative embodiments may be provided for the securing means 114.

Figure 9:
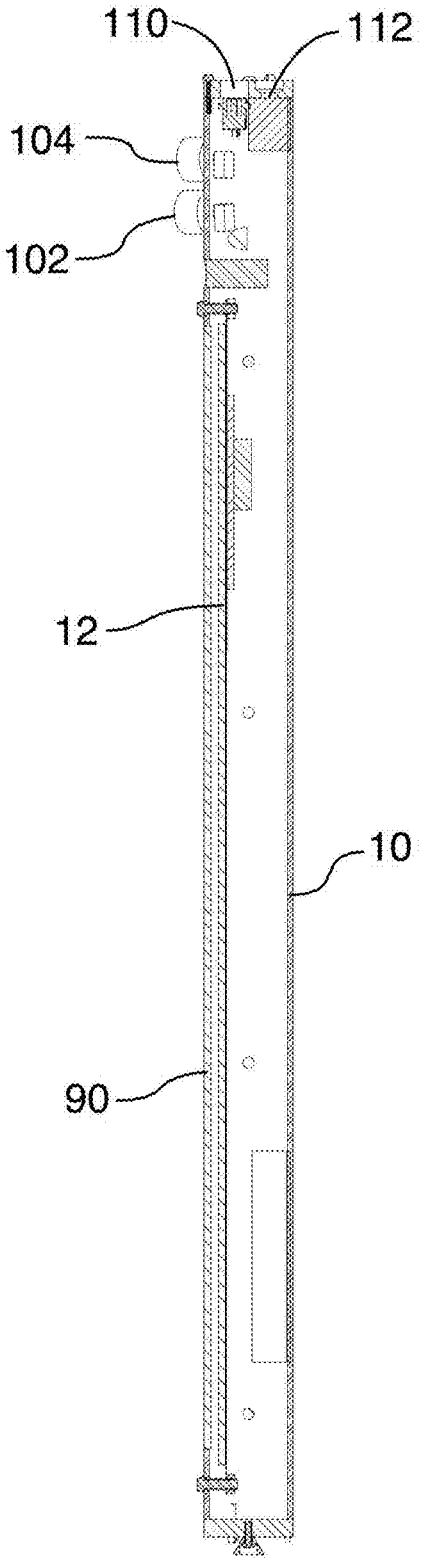
FIG. 9 is a cross-section view of an embodiment of the electronic instrument taken along lines AA.

Now referring to FIG. 9, there is shown a cross-section view of the electronic instrument 6.

In particular, it is shown how the plurality of sensors 12 is located with respect to the transparent medium 90.

Figure 10:
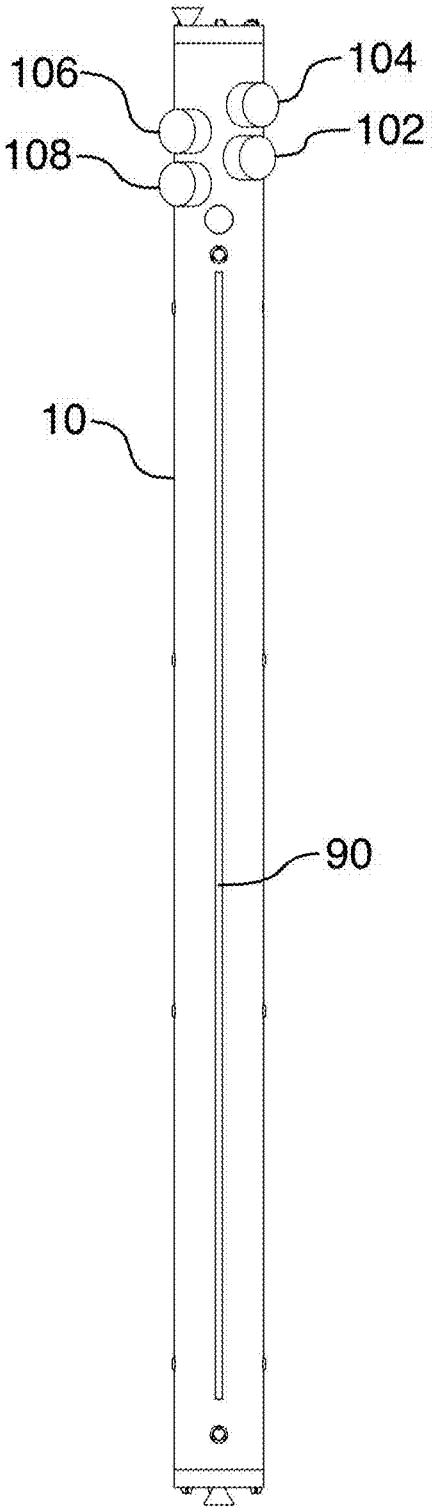
FIG. 10 is a front elevation view of the electronic instrument.
Figure 11:
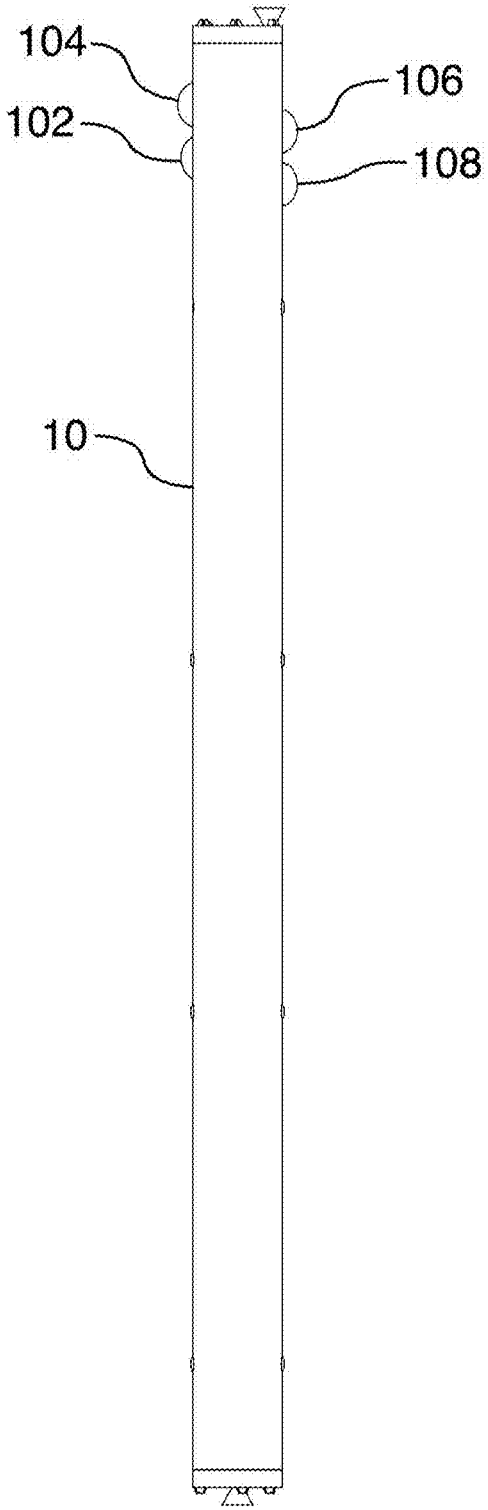
FIG. 11 is a rear elevation view of the electronic instrument.

FIGS. 10 and 11 further show a front and rear view of the electronic instrument 6.

Figure 12:
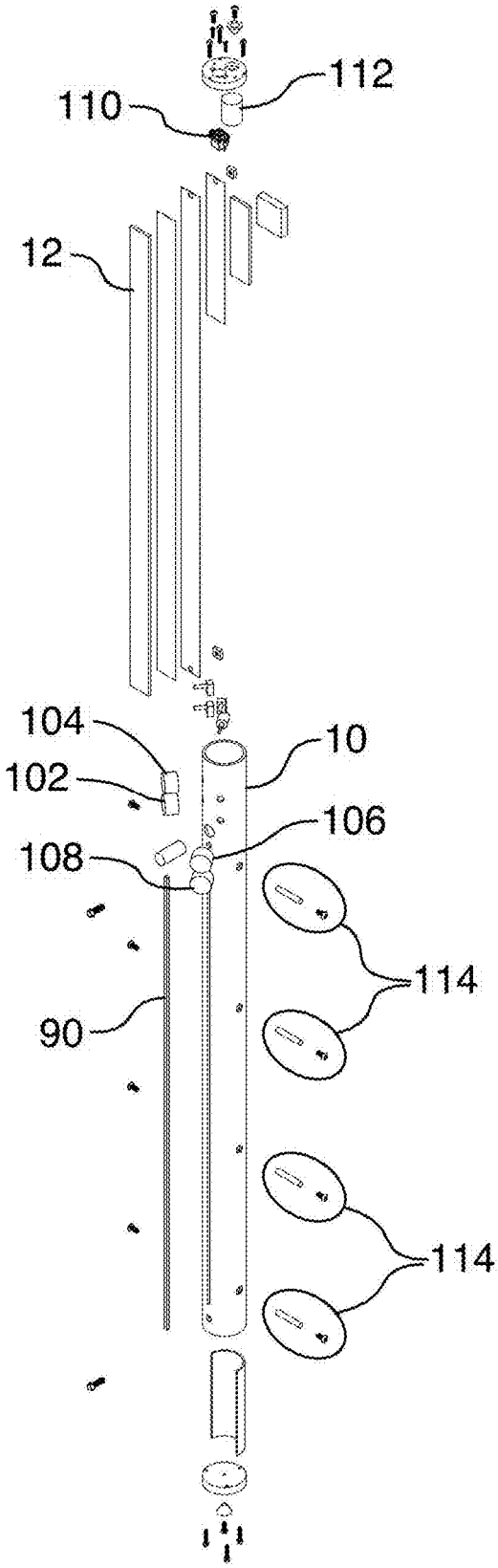
FIG. 12 is an exploded view of the electronic instrument.

Now referring to FIG. 12, there is shown an exploded view of the electronic instrument 6 illustrating how the electronic instrument 6 is manufactured according to one embodiment. The skilled addressee will appreciated that various alternative embodiments may be provided for manufacturing the electronic instrument 6.

Also, it will be appreciated that the processing of the sensor readings may be customized. Moreover, it will be appreciated that the reading of the sensor may be provided to various locations using a configuration script.

Although the above description relates to a specific preferred embodiment as presently contemplated by the inventor, it will be understood that the invention in its broad aspect includes functional equivalents of the elements described herein.

The invention claimed is:

1. An electronic instrument, comprising:

an elongated member, comprising:

at least one strap;

a plurality of detectors aligned in the elongated member, each detector for detecting a finger-sized object in the vicinity thereof and for providing a corresponding signal, wherein the plurality of detectors comprises a plurality of proximity sensor cells mounted on the at least one strap; and a processing unit operatively connected to the plurality of detectors, the processing unit for receiving the signals from the plurality of detectors and for generating a signal indicative of a sound to generate;

wherein the elongated member further comprises a slot extending into the surface of the elongated member and further wherein the electronic instrument comprises a transparent medium inserted in the slot such that the plurality of proximity sensor cells are located inside the elongated member behind the transparent medium; and wherein the processing unit is located inside the elongated member.

2. The electronic instrument as claimed in claim 1, wherein the elongated member comprises more than one strap, each strap of the more than one strap comprising sensor cells, wherein the more than one strap are connected together using a data bus.

3. The electronic instrument as claimed in claim 1, wherein the plurality of proximity sensor cells comprises infrared proximity sensor cells.

4. The electronic instrument as claimed in claim 1, wherein the at least one strap is flexible.

5. The electronic instrument as claimed in claim 1, wherein the transparent medium is selected from a group consisting of a plastic member and a flexible plastic tube.

6. The electronic instrument as claimed in claim 1, further comprising an input/output device operatively connected to the processing unit, the input/output device for obtaining an input from a user, wherein the processing unit further receives an input signal and generates a signal indicative of a sound to generate using the signals from the plurality of detectors and the input from the user.

7. The electronic instrument as claimed in claim 6, wherein the input/output device is further used for providing data originating from the processing unit to a device operatively connected to the electronic instrument via the input/output device.

8. The electronic instrument as claimed in claim 7, wherein the data originating from the processing unit comprises data representative of the signals from the plurality of detectors.

9. The electronic instrument as claimed in claim 7, wherein the data originating from the processing unit comprises the signal indicative of a sound to generate, further wherein the device operatively connected to the electronic instrument via the input/output device comprises a sound generating unit receiving the signal indicative of a sound to generate and generating the sound accordingly.

10. The electronic instrument as claimed in claim 6, wherein the input/output device further receives a signal from a remote device, further wherein the processing unit receives the signal from the device and generates a signal indicative of a sound to generate using at least the signals from the plurality of detectors, the input from the user and the signal from the device.

11. The electronic instrument as claimed in claim 10, wherein the remote device comprises another plurality of detectors.

12. The electronic instrument as claimed in claim 6, wherein the input from the user comprises at least one of a user-defined script.

13. The electronic instrument as claimed in claim 6, wherein the input/output unit further comprises an accelerometer providing accelerometer data, further wherein the signal indicative of a sound to generate is generated using the accelerometer data.

14. The electronic instrument as claimed in claim 12, wherein the input from the user comprises at least a configuration file comprising a plurality of configurations, further wherein the input/output device comprises a configuration selector for selecting one of the plurality of configurations.

15. The electronic instrument as claimed in claim 14, wherein the input/output device comprises a LED indicator for providing an indication of a status of the electronic instrument.

16. The electronic instrument as claimed in claim 14, wherein the input/output device comprises at least one effect data selector, each of the at least one effect data selector for providing a corresponding effect data, wherein the sound to generate is generated using the at least one corresponding effect data.

17. The electronic instrument as claimed in claim 1, wherein the elongated member has a cylindrical shape.

18. The electronic instrument as claimed in claim 1, wherein the elongated member is made of a material selected from a group consisting of aluminum, plastic, carbon fiber and a clear to infrared impact resistant polycarbonate.

19. A method for using an electronic instrument claimed in claim 1, the method comprising:

calibrating the electronic instrument;

selecting a configuration; and playing with the electronic instrument.

20. The method as claimed in claim 19, wherein the calibration of the electronic instrument comprises:

selecting a "zero calibration" mode;

performing a "zero calibration", said "zero calibration" for defining a first distance such that if an object is detected by a first given detector of the plurality of detectors at a distance greater than the first distance, the value of the first given detector will be set to be zero, selecting a "full calibration," and performing the "full calibration," said "full calibration" for defining a second distance such that if an object is detected by a second given detector of the plurality of detectors at a distance shorter than the second distance, the value of the second given detector will be set to be a maximum value.

21. The method as claimed in claim 20, wherein the performing of the "zero calibration" is performed by providing a planar object at the first distance from the plurality of detectors, further wherein the "full calibration" is performed by providing the planar object at the second distance from the plurality of detectors.

* * * * *